US005899526A

United States Patent [19]

LaPointe et al.

[11] Patent Number: 5,899,526

[45] Date of Patent: May 4, 1999

[54] TRAY TABLE FOR HEALTH CASE CHAIRS

[75] Inventors: Larry P. LaPointe, Temperance; Jonathan R. Saul, Erie; Dennis W. Wright; Richard E. Marshall, both of Monroe, all of Mich.

[73] Assignee: La-Z-Boy Incorporated, Monroe, Mich.

[21] Appl. No.: 09/126,214

[22] Filed: Jul. 30, 1998

[51] Int. Cl.[6] ..... A47C 7/68

[52] U.S. Cl. ..... 297/173; 297/188.18; 297/188.2; 248/231.31; 248/289.11

[58] Field of Search ..... 297/173, 188.14, 297/188.15, 188.18, 411.38, 188.2; 108/49, 152; 248/289.11, 292.12, 231.31

[56] References Cited

U.S. PATENT DOCUMENTS 3,575,466 4/1971 Thomas et al. .
3,586,367 6/1971 Cincotta .
3,586,368 6/1971 Guild .
4,566,732 1/1986 Ostergaard, II et al. .
4,685,726 8/1987 Wolpert, Jr. .
5,026,114 6/1991 Miller ..... 297/188.15
5,144,898 9/1992 Posly .
5,333,929 8/1994 Slagerman .
5,765,911 6/1998 Sorenson .

*Primary Examiner*—Peter R. Brown
*Attorney, Agent, or Firm*—Harness, Dickey & Pierce, P.L.C.

[57] ABSTRACT

A tray table assembly for a chair is disclosed which is adapted for use in a health care environment. The tray table assembly enables a seated occupant or care giver to quickly and conveniently pivot the tray table in various incremental positions throughout a generally horizontal 360° circular path. The tray table assembly includes a main tray assembly pivotally coupled to a mounting arm assembly to facilitate the lateral adjustments of the tray table. Furthermore, the tray table assembly includes a locking mechanism for quickly and conveniently mounting and demounting the tray table assembly from the health care chair. Still further, the tray table assembly includes positioning means for retaining the tray table in the desired position.

19 Claims, 6 Drawing Sheets

FIG 1
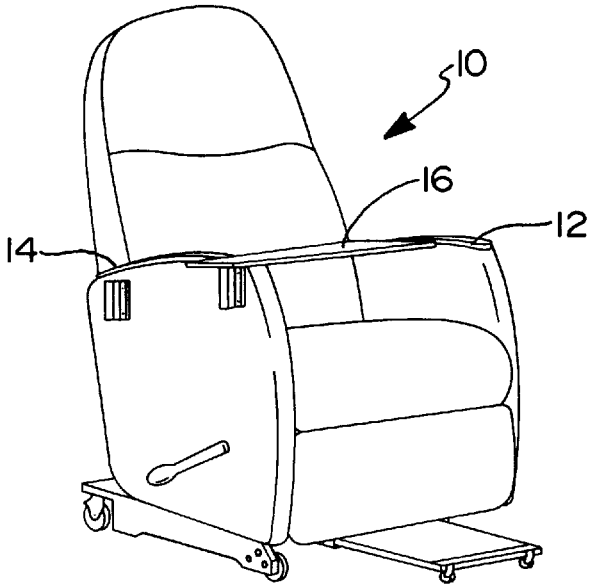
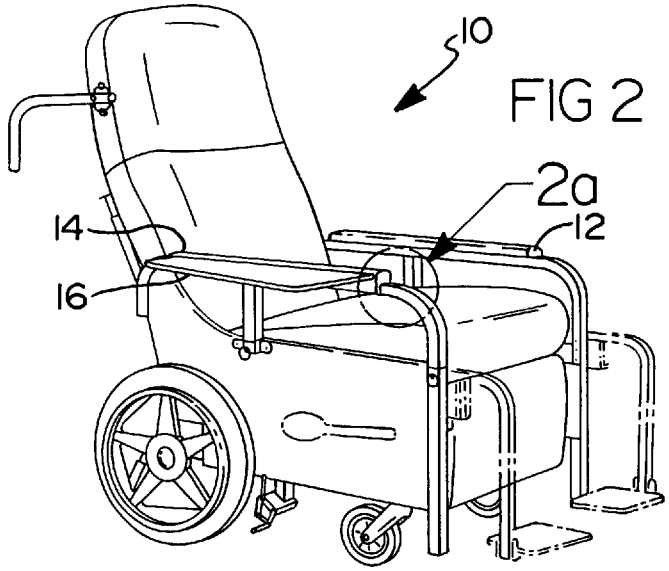
FIG 2
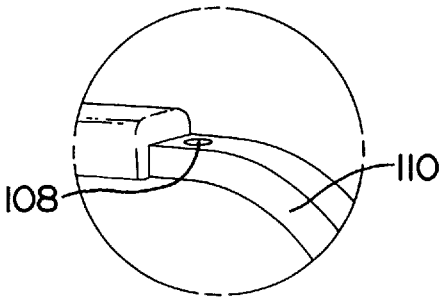
FIG 2a

FIG 4
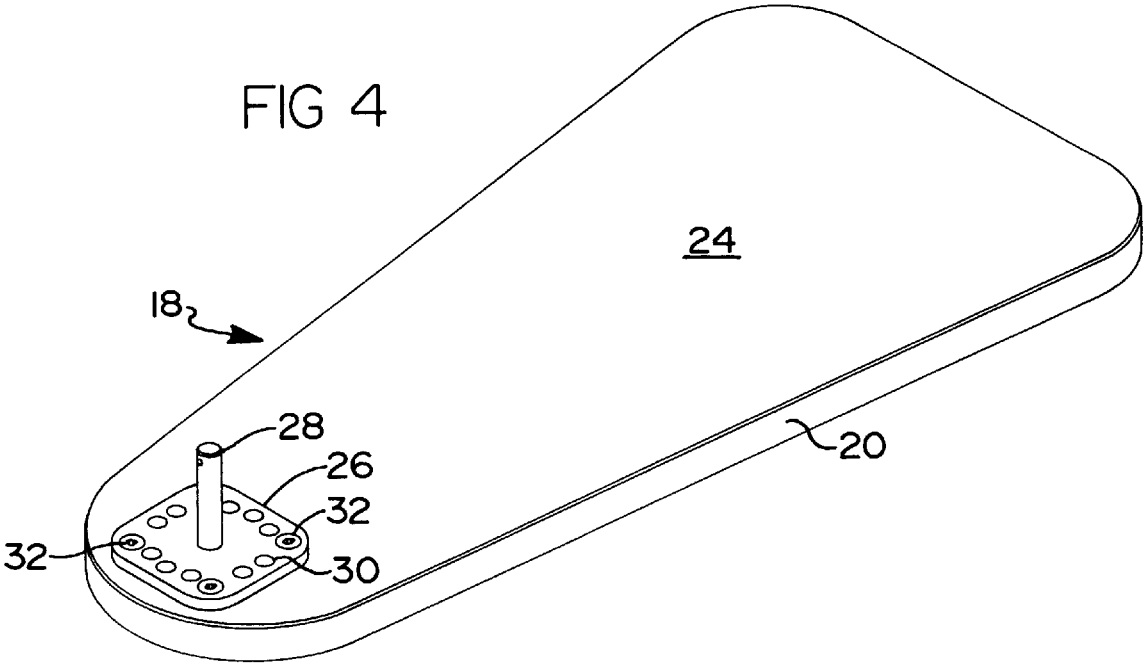
FIG 5
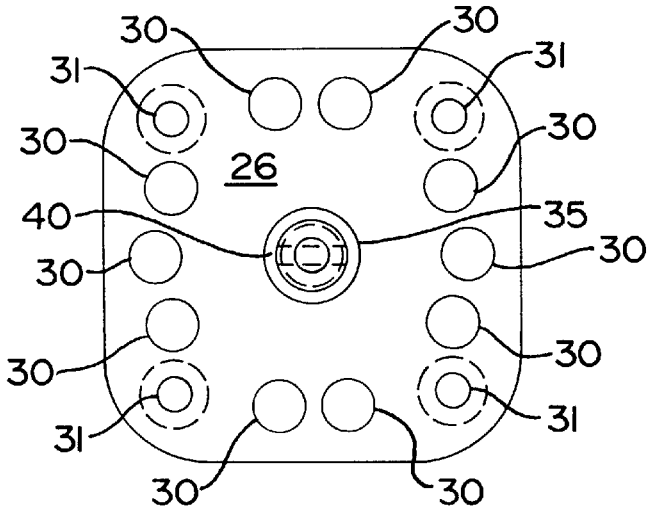
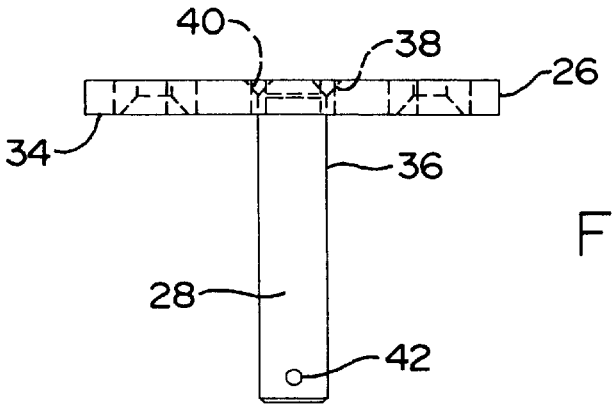
FIG 6

FIG 8
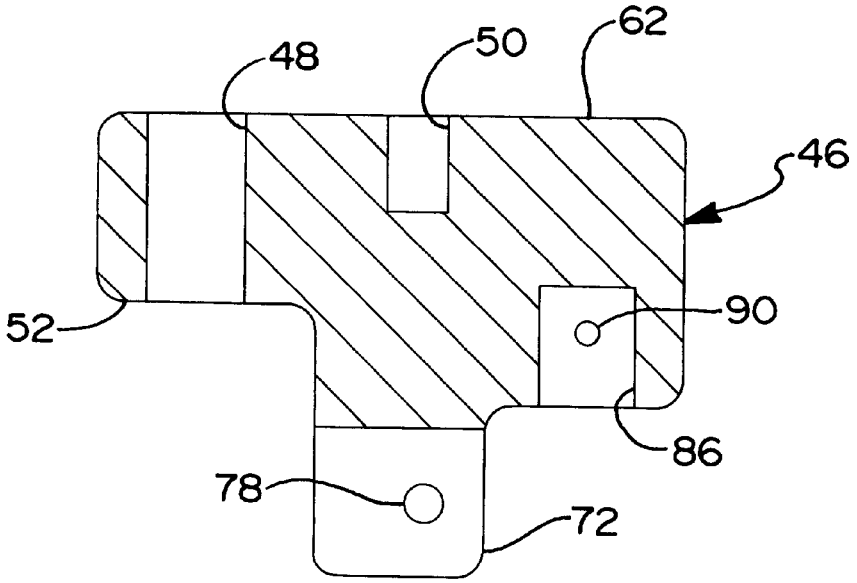
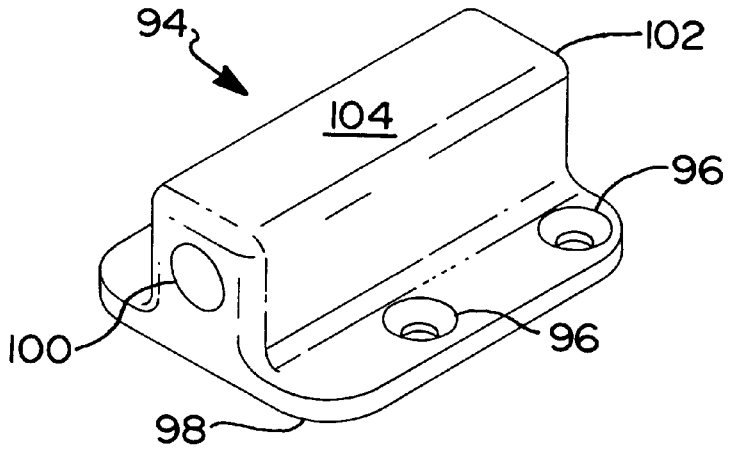
FIG 9

TRAY TABLE FOR HEALTH CASE CHAIRS

BACKGROUND OF THE INVENTION

1. Field of the Invention

The present invention relates to a tray table and, more particularly, to a tray table assembly operably mounted to a chair for use in a health care environment, wherein the tray table assembly is capable of being pivoted into multiple lateral positions conducive to various health care needs.

2. Background of the Invention

Health care chairs have been used in a variety of residential and commercial health care environments and are adapted to provide various comfort and therapeutic features to aid in the care of elderly and physically challenged individuals. Some of these health care chairs are capable of placing the seated occupant in an infinite number of seated positions, while others provide the seated occupant with improved mobility in and around the health care facility. While these health care chairs greatly enhance the comfort and mobility of such elderly and physically challenged individuals, health care chairs have the disadvantage that they may not generally be brought in close proximity to tables or desks. This makes writing, eating, resting, and standard medical procedures such as injecting intravenous medications, removing blood samples, and testing blood pressure, which require a rigid surface in close proximity to the individual, more difficult.

Attempts have been made in the art to provide tray table assemblies capable of being used similar to a conventional table, which are adapted to be mounted to various chair types. However, few of these mountable table assemblies have been developed that are capable of being positioned in numerous lateral orientations. Moreover, fewer of these table assemblies are adapted to enable a seated occupant or care giver to quickly and conveniently mount the table assembly on or demount the table assembly from the chair.

A first known design merely enables a chair-mounted table to be placed in one or two orientations. For example, U.S. Pat. No. 3,575,466, issued to Morton et al., discloses a chair-mounted table adapted to be positioned in front of the seated occupant or vertically stored along side the occupant. U.S. Pat. No. 5,026,114, issued to Miller, merely teaches a table adapted to be positioned in front of the seated occupant or horizontally pivoted to the side of the occupant.

Furthermore, known designs fail to provide a chair-mounted table assembly adapted to be conveniently mounted or demounted from the chair. For example, U.S. Pat. No. 5,765,911, issued to Sorenson, teaches a positioning system for a chair-mounted table having a plurality of adjusting features, yet fails to allow a seated occupant to conveniently mount or demount the table assembly from the chair.

Another problem encountered with these known designs is that the conventional forms of chair-mounted tables fail to adequately support an occupant's arm during standard medical procedures, such as those described above. In particular, chair-mounted tables used in the health care industry may be used as a means for supporting the seat occupant's forearm while blood samples are taken. Typically during these procedures, the patient's arm is extended outright or to the side, thereby exposing the patient's forearm. Unfortunately, when using the chair-mounted tables known in the art, the lack of adjustability of the table assembly tends to impede their use.

Therefore, it is desirable to provide a simply constructed and easily operated chair-mounted table assembly that is capable of being pivoted into multiple positions conducive to various health care needs. Furthermore, it is desirable to provide a chair-mounted table assembly that is capable of being quickly and conveniently mounted and demounted from the health care chair by the seated occupant or care giver.

SUMMARY OF THE INVENTION

In accordance with the principles of the present invention, a tray table assembly for a chair is disclosed which is adapted for use in a health care environment.

In a preferred embodiment, the invention includes a tray table having a pivoting device mounted to a bottom surface of the tray table. The pivoting device is pivotally mounted to a mounting arm assembly to enable the tray table to pivotally rotate through a generally horizontal, circular path. The mounting arm assembly is mounted to the health care chair to support the weight of the tray table assembly. However, it is anticipated that the pivoting device may be directly mounted to the health care chair depending on the chair's design characteristics. The invention further includes positioning means for retaining the tray table in a preferred position.

It is a primary object of the present invention to provide a tray table assembly for a health care chair which includes an improved construction to permit simple and convenient lateral adjustment of the tray table throughout a generally horizontal, circular path.

It is a further object of the present invention to provide a tray table assembly for a health care chair which is quickly and conveniently mounted and demounted from the health care chair by the seated occupant or care giver.

It is yet another object of the present invention to provide a main tray assembly having a pivot plate coupled to the bottom of a tray, whereby a pivot pin extends orthogonally therefrom. The pivot pin is received within a pivot aperture disposed in the mounting arm of a mounting bracket assembly to facilitate rotation.

It is still yet another object of the present invention to provide positioning means including a plurality of apertures disposed in incremental locations around either a pivot plate or a mounting bracket. A corresponding positioning pin extending orthogonally from the other of the pivot plate or mounting bracket which cooperates with the plurality of apertures to retain the tray in various lateral positions about a circular path.

Further areas of applicability of the present invention will become apparent from the detailed description provided hereinafter. It should be understood however that the detailed description and specific examples, while indicating the preferred embodiment of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1 is a perspective view of an exemplary health care chair having a first embodiment of a tray table assembly according to the principles of the present invention mounted thereto;

FIG. 2 is a perspective view of another exemplary health care chair having a second embodiment of a tray table assembly according to the principles of the present invention mounted in an alternate position;

FIG. 2*a* is a detailed perspective view, similar to FIG. 2, showing the mounting aperture and retaining surfaces of the second embodiment of the tray table assembly;

FIG. 4 is a perspective view of the underside of the main tray assembly having a pivot plate and pivot pin for pivotally adjusting the main tray assembly;

FIG. 5 is a top view, with portions in phantom, of the pivot plate having a plurality of positioning apertures;

FIG. 6 is a side view, with portions in phantom, of the pivot plate and pivot pin;

FIG. 8 is a cross-sectional view taken along line 8—8 of FIG. 7;

FIG. 9 is a perspective view of the support bracket; and

DETAILED DESCRIPTION OF THE PREFERRED EMBODIMENTS

The following description of the preferred embodiments is merely exemplary in nature and is in no way intended to limit the invention, its application, or uses.

Referring to FIGS. 1 and 2, a chair 10 is provided which is adapted for use in a health care environment. Chair 10 preferably includes a pair of side arms 12, 14 disposed on opposing sides of chair it. Side arms 12, 14 may either be nonupholstered, upholstered (see FIG. 1), or merely cushioned (see FIG. 2). Exemplary health care chairs are illustrated in commonly assigned U.S. patent application Ser. Nos. 08/659,998 ('998) and 08/892,048 ('048). The '998 application discloses a health care chair having substantially upholstered side arms, wherein the chair is adapted to place the seated occupant in an infinite number of seated positions (see FIG. 1 of the present disclosure). Alternatively, the '048 application illustrates a health care chair having cushioned, tubular side arms, wherein the chair is wheeled for improved mobility (see FIG. 2 of the present disclosure).

Still referring to FIGS. 1 and 2, chair 20 further includes a tray table assembly 16 mounted to one of side arms l2, 14. The specific mounting procedure of tray table assembly 16 to chair 10 will be described in detail below.

Figure 3:
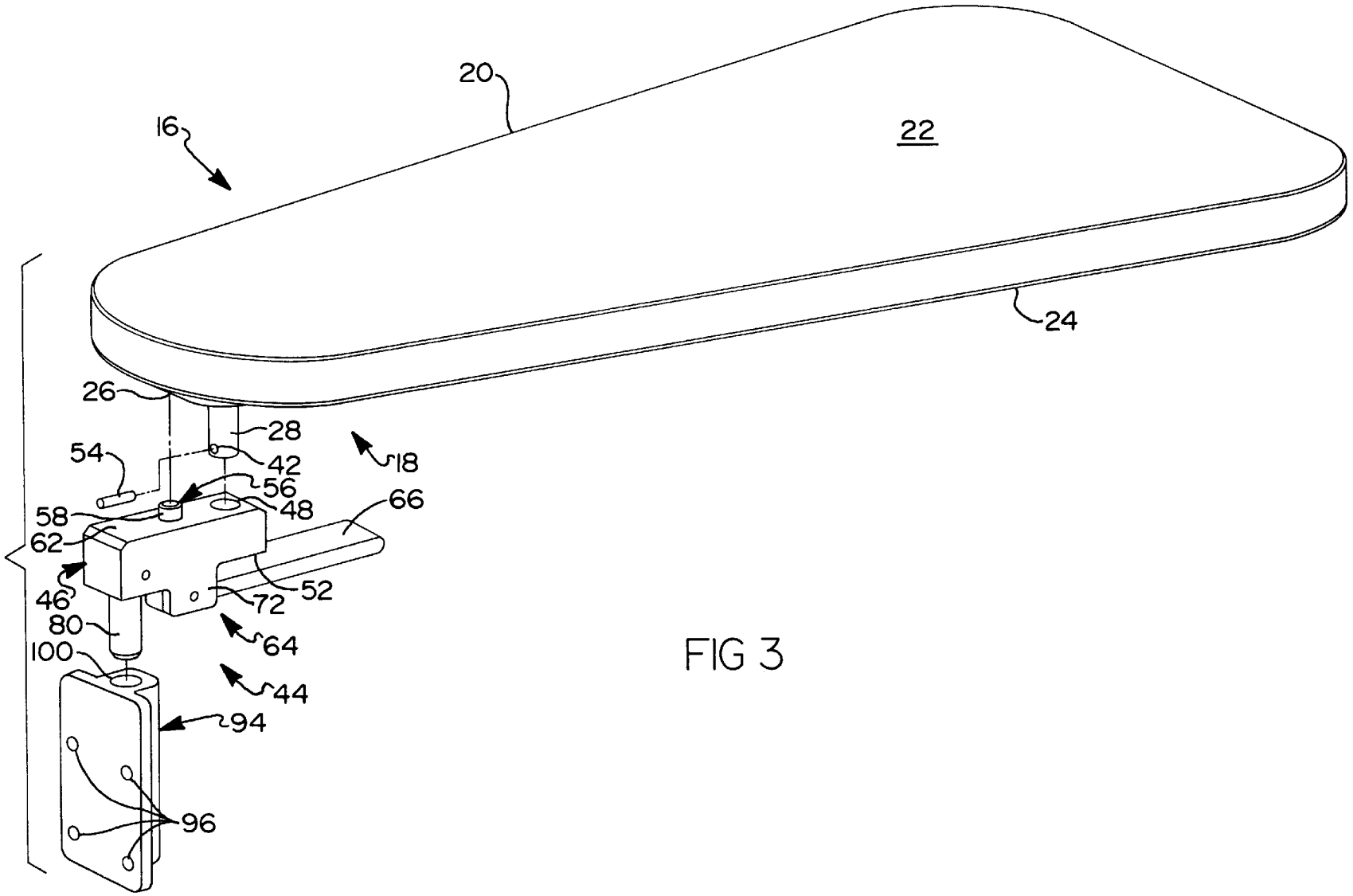
FIG. 3 is an exploded perspective view of the tray table assembly having a main tray assembly, a mounting arm assembly, and a support bracket.

As best seen in FIG. 3, tray table assembly 16 includes a main tray assembly 18 for supporting a preferred object thereon. Main tray assembly 18 includes a tray 20 having a top portion 22 and a bottom portion 24. Tray 20 is preferably triangularly-shaped with rounded corners. This shape is necessary to provide use on either side of the chair and to prevent portions of the front of the tray extending into the occupant's seating area when the tray is rotated. Tray 20 is preferably made from laminated material for improved strength characteristics. However, it is anticipated that tray 20 may be manufactured from any material possessing desired design attributes. More preferably, top portion 22 of tray 20 is a generally flat, smooth surface. Although, it is anticipated that top portion 22 of tray 20 may include recesses, depressions, or similar means for retaining a preferred object such as a plate or beverage container. Main tray assembly 18 may further include an edge molding (not shown) disposed around a periphery of tray 20.

As best seen in FIGS. 4, 5, and 6, main tray assembly 18 includes a pivot plate 26 and a pivot pin 28. Preferably, pivot plate 26 is generally square-shaped and made from 0.250" steel or other suitable material. Pivot plate 26 includes a plurality of positioning apertures 30 to enable tray 20 to be positioned at various incremental positions about a 360° circular path. This positioning feature of the present invention will be described in detail below. Pivot plate 26 further includes four (4) counter-sunk openings 31 disposed through opposing corners of the generally square-shaped plate. Pivot plate 26 is mounted to bottom portion 24 of tray 20 using four (4) screws or other suitable fasteners 32 extending through counter-sunk openings 31. Preferably, screws 32 are ¼"-20×¾" flat-head screws to provide an unobstructed flat surface 34.

Still referring to FIGS. 4, 5, and 6, pivot pin 28 extends orthogonally from bottom portion 24 of tray 20 through an opening 35 disposed centrally in pivot plate 26. Pivot pin 28 includes a generally cylindrical portion 36 and a tapered portion 38. Tapered portion 38 of pivot pin 28 is adapted to closely conform to a correspondingly tapered portion 40 of opening 35. Pivot pin 28 is retained in position within opening 35 by welding or other suitable joining means. Pivot pin 28 further includes an aperture 42 for receiving a pin therethrough, as discussed in detail below.

Figure 7:
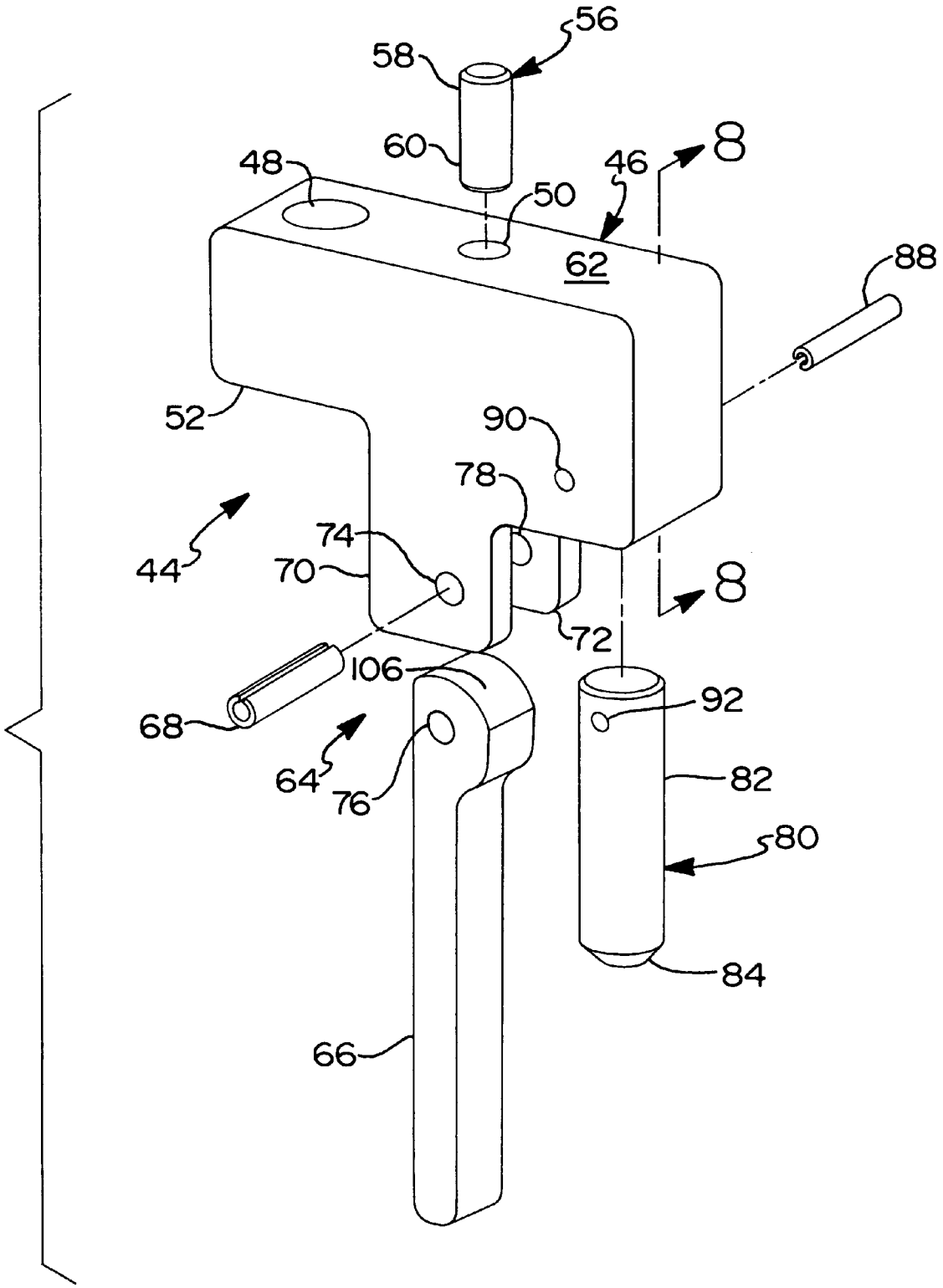
FIG. 7 is an exploded perspective view of the mounting arm assembly.

Referring to FIGS. 3, 7, and 8, tray table assembly 16 further includes a mounting arm assembly 44. Mounting arm assembly 44 includes a mounting arm 46, preferably made from a 3.125"×2.500"×1.250" aluminum block or other suitable material, having an aperture 48 and a first bore 50. Aperture 48 of mounting arm 46 is adapted to receive pivot pin 28 therethrough. More specifically, pivot pin 28 is inserted through aperture 48 of mounting arm 46, thereby extending beyond a lower surface 52 of mounting arm 46. A pin 54 (FIG. 3) is inserted through aperture 42 of pivot pin 28 to pivotally retain pivot pin 28 in aperture 48 of mounting arm 46. Preferably, a light grease film is provided on pivot pin 28 prior to insertion through aperture 48 to facilitate assembly and operation.

Still referring to FIGS. 3, 7, and 8, first bore 50 of mounting arm 46 is adapted to receive a positioning stud 56 therein. Positioning stud 56 is preferably a 5/16" dowel pin. Positioning stud 56 is press-fit into first bore 50 such that a head portion 58 extends above an upper surface 62 of mounting arm 46. More preferably, a thread sealer, such as LOCTITE, is provided along a base portion 60 of positioning stud 56 to further retain positioning stud 56 within first bore 50 of mounting arm 46. Head portion 58 of positioning stud 56 is conformed to be received within the plurality of positioning apertures 30 of pivot plate 26 to enable tray 20 to be positioned at various incremental positions throughout a 360° circular path.

Mounting arm assembly 44 further includes a locking mechanism 64 having a locking handle 66 and a spring pin 68. Locking handle 66 is positioned between opposing plates 70, 72 of mounting arm 46. Spring pin 68 is inserted through an aperture 74 in plate 70, a bore 76 of locking handle 66, and a corresponding aperture 78 in plate 72. Spring pin 68 operably retains locking handle 66 with mounting arm 46 such that locking handle 66 may pivot between an unlocked and a locked position.

Still referring to FIGS. 3, 7, and 8, mounting arm assembly 44 still further includes a mounting pin 80 having a generally cylindrical portion 82 and tapered end 84. Mounting pin 80 is adapted to be received and retained within a second bore 86 of mounting arm 46. Specifically, mounting pin 80 is disposed in second bore 86 of mounting arm 46 and retained therein using a pin 88 inserted through a pin aperture 90 of mounting arm 46 and a corresponding pin aperture 92 of mounting pin 80.

Figure 10:
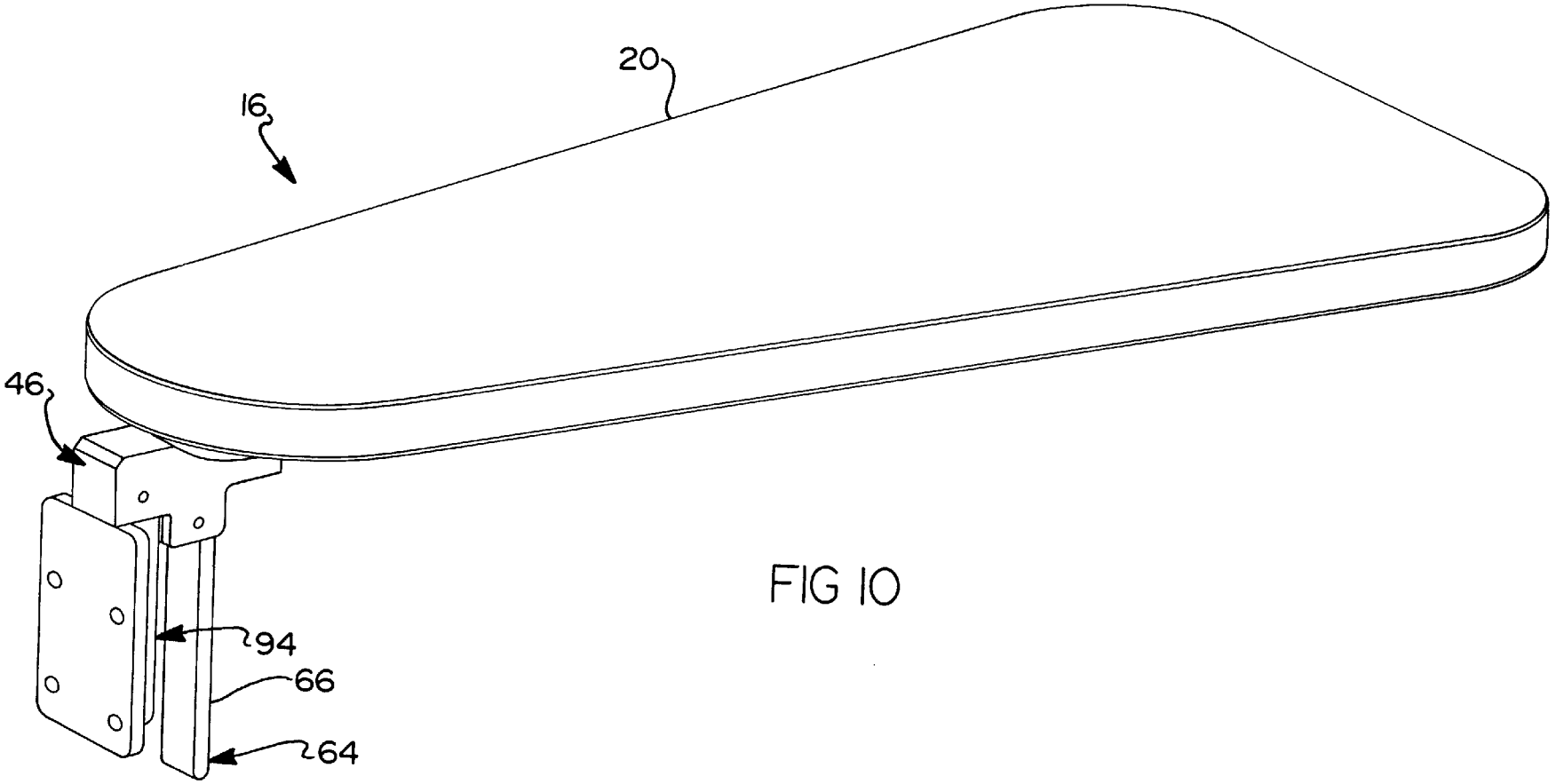
FIG. 10 is a perspective view of the tray table assembly, similar to FIG. 3, shown in an assembled and locked position.

Referring now to FIGS. 3 and 9, a support bracket 94 is shown for coupling mounting arm assembly 44 to chair 10 (FIG. 1). Support bracket 94 is preferably made of aluminum or other suitable material and includes a plurality of apertures 96 extending through a base portion 98 and a mounting aperture 100 extending through a raised portion 102. Support bracket 94 is mounted to side arm 12, 14 of chair 10 (FIG. 1) using a plurality of fasteners (not shown) extending through the plurality of apertures 96 of base portion 98. Preferably, a plurality of support brackets 94 are mounted to side arms 12, 14 of chair 10 at the following positions relative to a seat occupant: fore-left, fore-right, aft-left, and aft-right. Mounting aperture 100 of raised portion 102 is adapted to receive mounting pin 80 of mounting arm 46 therein, thereby operably supporting tray 20. Support bracket 94 further includes a substantially flat locking surface 104 adapted to contact and frictionally retain a camming surface 106 (FIG. 7) of locking handle 66 when mounting arm 46 is in a mounted and locked position (FIG. 10). It is anticipated that support bracket 94 may also be used to support other medical equipment, such as a pole for an intravenous drip or the like, when mounting arm 46 is not coupled thereto.

During assembly, main tray assembly 18 is coupled to mounting arm assembly 44 by disposing pivot pin 28 of main tray assembly 18 through aperture 48 of mounting arm assembly 44. Pivot pin 28 is operably retained within aperture 48 by inserting pin 54 through aperture 42 of pivot pin 28. It is anticipated that once main table assembly 18 is coupled to mounting arm assembly 44, it will be unnecessary to separate them.

During operation, mounting arm assembly 44 is removably mounted to support bracket 94 by first positioning locking handle 66 in a generally horizontal, unlocked position (FIG. 3). Mounting pin 80 of mounting arm assembly 44 is then inserted through mounting aperture 100 of support bracket 94. Locking handle 66 is then pivoted into a generally vertical, locked position. More particularly, locking handle 66 is pivoted downwardly (FIG. 10) causing camming surface 106 of locking handle 66 to forcibly engage locking surface 104 of support bracket 94. This forcible engagement frictionally retains mounting arm assembly 44 to support bracket 94 and minimizes any "play" that exists between support bracket 94 and mounting arm assembly 44, thereby providing a generally stable tray surface.

During pivotal adjustment, main tray assembly 18 is lifted vertically to cause head portion 58 of positioning stud 56 to disengage from aperture 30 of pivot plate 26. Tray 20 is then pivoted generally horizontally into a preferred position. For example, to facilitate eating and writing, tray 20 is preferably positioned directly in front of the seated occupant (FIG. 1). Alternatively, to support the seated occupant's arm during a medical procedure, tray 20 is preferably positioned to the side of the seated occupant (FIG. 2). Once a preferred position is selected, tray 20 is then secured in that position by engaging positioning stud 56 with the corresponding aperture 30. This method being thus described enables the seated occupant or care giver to quickly and conveniently position the main tray assembly into any preferred position conducive to a patient's health care needs.

According to a second embodiment of the present invention, mounting arm assembly 44 is mounted directly to either side arm 12, 14 of chair 10 (see FIGS. 2 and 2*a*), without the need for support bracket 94. As described above, mounting arm assembly 44 is adapted to be removably mounted to a health care chair having tubular side arms as disclosed in U.S. patent application Ser. No. 08/892,048. However, it is anticipated that mounting arm assembly 44 may be removably mounted to various chairs having a locking surface adapted to engage camming surface 106 of locking handle 66.

Still referring to FIGS. 2 and 2*a*, mounting pin 80 of mounting arm assembly 44 is disposed and extends through a mounting aperture 108 of tubular side arm 12, 14. Mounting aperture 108 may be positioned in various locations conducive to health care needs, such as the fore-left, fore-right, aft-left, and aft-right corners of side arm 12, 14, relative to the seated occupant. Locking handle 66 of locking mechanism 64 is then pivoted to engage an adjacent side surface 110 of either tubular side arm 12 or 14, thereby similarly preventing removal of main tray assembly 18 as described above.

the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tray table for a health care chair, said tray table comprising:

a tray having a top surface and a bottom surface;

a pivot plate being mounted to said bottom surface of said tray;

a pivot pin extending orthogonally from and being coupled to said pivot plate;

a mounting arm having an aperture for operably and slidably receiving said pivot pin to enable generally horizontal rotation of said tray relative to said mounting arm;

a generally cylindrical mounting pin being coupled with said mounting arm, said generally cylindrical mounting pin being adapted to be received within an aperture of the health care chair for removably mounting die tray table to the health care chair;

a locking mechanism being secured to said mounting arm, said locking mechanism being adapted to retain said generally cylindrical mounting pin within said aperture of the health care chair; and positioning means disposed between said pivot plate and said mounting arm for retaining said tray in a preferred horizontal position.

2. The tray table according to claim 1 wherein said positioning means comprises:

a plurality of positioning apertures being disposed in said pivot plate, said plurality of positioning apertures being radially disposed about said pivot plate; and a positioning stud being coupled with said mounting arm, said positioning stud being adapted to engage one of said plurality of positioning apertures of said pivot plate, thereby retaining aid tray in a preferred position.

3. The tray table according to claim 1 wherein said locking mechanism comprises:

a locking handle having a camming surface, said locking handle being pivotally coupled to said mounting arm, said camming surface adapted to engage a surface adjacent said aperture of the health care chair.

4. The tray table according to claim 1 wherein said tray is generally triangularly-shaped.

5. The tray table according to claim 4 wherein said triangularly-shaped tray includes two generally equal length sides.

6. A table apparatus for a health care chair, said apparatus comprising:

a tray having a top surface and a bottom surface;

a pivot plate being mounted to said bottom surface of said tray;

a pivot pin extending orthogonally from and being coupled to said pivot plate;

a support bracket being mounted to the health care chair;

a mounting arm having an aperture for operably and slidably receiving said pivot pin to enable generally horizontal rotation of said tray relative to said mounting arm;

a generally cylindrical mounting pin being coupled with said mounting arm, said generally cylindrical mounting pin adapted to be received within an aperture of said support bracket;

a locking mechanism being secured to said mounting arm, said locking mechanism being adapted to retain said generally cylindrical mounting pin within an aperture of said support bracket; and positioning means disposed between said pivot plate and said mounting arm for retaining said tray in a preferred position.

7. The table apparatus according to claim 6 wherein said positioning means comprises:

a plurality of positioning apertures being disposed in said pivot plate, said plurality of positioning apertures oriented generally circularly around said pivot plate;

a positioning stud being coupled with said mounting arm, said positioning stud being adapted to engage one of said plurality of positioning apertures of said pivot plate, thereby retaining said tray in a preferred position.

8. The table apparatus according to claim 6 wherein said locking mechanism comprises:

a locking handle having a camming surface, said locking handle being pivotally coupled to said mounting arm, said camming surface adapted to engage a locking surface of said support bracket.

9. The table apparatus according to claim 6 wherein said tray is generally triangularly-shaped.

10. The tray table according to claim 9 wherein said triangularly-shaped tray includes two generally equal length sides.

11. A health care chair comprising:

a chair frame including a pair of side frame members;

a tray having a top surface and a bottom surface;

a pivot plate being mounted to said bottom surface of said tray;

a pivot pin extending orthogonally from and being coupled to said pivot plate;

a mounting arm having an aperture for operably and slidably receiving said pivot pin to enable generally horizontal rotation of said tray relative to said mounting arm;

a generally cylindrical mounting pin being coupled with said mounting arm, said generally cylindrical mounting pin being received within an aperture of said chair frame;

a locking mechanism being secured to said mounting arm, said locking mechanism retaining said generally cylindrical mounting pin within said aperture of said chair frame; and positioning means disposed between said pivot plate and said mounting arm for retaining said tray in a preferred position.

12. The health care chair according to claim 11 wherein said positioning means comprises:

a plurality of positioning apertures being disposed in said pivot plate, said plurality of positioning apertures being radially disposed around said pivot plate; and a positioning stud being coupled with said mounting arm, said positioning stud being adapted to engage one of said plurality of positioning apertures of said pivot plate, thereby retaining said tray in a preferred position.

13. The health care chair according to claim 11 wherein said locking mechanism comprises:

a locking handle having a camming surface, said locking handle being pivotally coupled to said mounting arm, said camming surface adapted to engage a surface of said chair frame.

14. The health care chair according to claim 11, further comprising:

a support bracket having an aperture being mounted to said chair frame, wherein said generally cylindrical mounting pin is disposed within said aperture of said support bracket.

15. The health care chair according to claim 14 wherein said pivoting device includes:

a pivot plate being mounted to said bottom surface of said tray; and a pivot pin extending orthogonally from and being coupled to said pivot plate.

16. The health care chair according to claim 14 wherein said positioning means comprises:

a plurality of positioning apertures being disposed in said pivot plate, said plurality of positioning apertures oriented generally circularly around said pivot plate; and a positioning stud being coupled with said mounting arm, said positioning stud being adapted to engage one of said plurality of positioning apertures of said pivot plate, thereby retaining said tray in a preferred position.

17. The health care chair according to claim 16 wherein said locking mechanism comprises:

a locking handle having a camming surface, said locking handle being pivotally coupled to said mounting arm, said camming surface adapted to engage a locking surface of said support bracket.

18. The health care chair according to claim 11 wherein said tray is generally triangularly-shaped.

19. The health care chair according to claim 18 wherein said triangularly-shaped tray includes two generally equal length sides.

* * * * *

UNITED STATES PATENT AND TRADEMARK OFFICE

CERTIFICATE OF CORRECTION

PATENT NO. : 5,899,526

DATED : May 4, 1999

INVENTOR(S) : Larry P. LaPointe, et. al.

It is certified that error appears in the above-identified patent and that said Letters Patent is hereby corrected as shown below:

Title page, item [56], under U.S. Documents insert the following:

| | | |
|---|---|---|
| --222,086 | 11/1879 | Slemmer |
| 860,328 | 07/1907 | Rose |
| 2,642,250 | 06/1953 | Kasnowich |
| 4,455,008 | 06/1984 | MacKew |
| 4,807,935 | 02/1989 | King |
| 4,913,393 | 04/1990 | Wood |
| 5,484,187 | 01/1996 | Doerner, et al. |
| 5,647,075 | 07/1997 | Perkins-- |

Title page, item [54] and col. 1, in the Title, "Case" should be --Care--

Column 3, Line 34;
"it" should be --10--;

UNITED STATES PATENT AND TRADEMARK OFFICE

CERTIFICATE OF CORRECTION

PATENT NO. : 5,899,526
DATED : May 4, 1999
INVENTOR(S) : Larry P. LaPointe, et al.

It is certified that error appears in the above-identified patent and that said Letters Patent is hereby corrected as shown below:

Column 3, Line 46; (Application Page 6, Line 21);
"20" should be --10--;

Column 6, Line 21; (Application Page 12, Line 10);
"the" should be --The--;

Column 6, Line 43, Claim 1; (Application Page 4, Line 9, Claim 27);
Amendment dated 1/7/99;
"die" should be --the--;

Column 6, Line 61, Claim 2; (Application Page 2, Line 8, Claim 4);
Amendment dated 1/7/99;
"aid" should be --said--.

Signed and Sealed this

Eleventh Day of January, 2000

*Attest:*

*Attesting Officer*

Q. TODD DICKINSON

*Acting Commissioner of Patents and Trademarks*